US006959506B2

(12) United States Patent
Adamic et al.

(10) Patent No.: US 6,959,506 B2
(45) Date of Patent: Nov. 1, 2005

(54) TORQUE LOCKING SYSTEM FOR FASTENING A WEAR MEMBER TO A SUPPORT STRUCTURE

(75) Inventors: Dwight L. Adamic, Edmonton (CA); Murray Smith, Edmonton (CA)

(73) Assignee: Quality Steel Foundries Ltd., Edmonton (CA)

( * ) Notice: Subject to any disclaimer, the term of this patent is extended or adjusted under 35 U.S.C. 154(b) by 0 days.

(21) Appl. No.: 09/882,825

(22) Filed: Jun. 16, 2001

(65) Prior Publication Data

US 2002/0000053 A1 Jan. 3, 2002

(30) Foreign Application Priority Data

Jun. 27, 2000 (CA) ..... 2312550

(51) Int. Cl.[7] ..... E02F 9/28

(52) U.S. Cl. ..... 37/456; 403/374.3; 172/753; 37/458

(58) Field of Search ..... 172/753, 751, 172/772; 403/374.3, 379.1, 379.2, 322.2, DIG. 6, 328; 37/450, 455, 456, 457, 458, 459, 449

(56) References Cited

U.S. PATENT DOCUMENTS

| | | | | | |
|---|---|---|---|---|---|
| 1,216,290 | A | * | 2/1917 | Dickson | 37/454 |
| 2,121,993 | A | | 6/1938 | Stocks | |
| 2,688,475 | A | | 9/1954 | Small | |
| 3,256,622 | A | | 6/1966 | Hostetter | |
| 3,410,010 | A | | 11/1968 | Ratkowski | |
| 4,288,172 | A | | 9/1981 | Livesay et al. | |
| 4,587,751 | A | * | 5/1986 | Sjogren et al. | 172/753 |
| 4,932,478 | A | | 6/1990 | Jones | |
| 5,009,017 | A | * | 4/1991 | Diekevers et al. | 37/456 |
| 5,172,501 | A | * | 12/1992 | Pippins | 37/453 |
| 5,233,770 | A | * | 8/1993 | Robinson | 37/452 |
| 5,337,495 | A | * | 8/1994 | Pippins | 37/452 |
| 5,435,084 | A | | 7/1995 | Immel | |
| 6,052,927 | A | * | 4/2000 | Pippins | 37/446 |
| 6,374,521 | B1 | * | 4/2002 | Pippins | 37/450 |
| 6,406,236 | B1 | * | 6/2002 | Olson, Jr. | |

FOREIGN PATENT DOCUMENTS

| | | |
|---|---|---|
| AU | 54288/80 | 1/1980 |
| AU | 199894126 A1 | 11/1998 |
| CA | 2067818 | 3/1992 |

* cited by examiner

*Primary Examiner*—Victor Batson
(74) *Attorney, Agent, or Firm*—Kohn & Associates, PLLC

(57) ABSTRACT

The present invention is directed to a releasable locking assembly for attaching a wear member to a support structure. It may be used with excavating equipment for attaching ground-engaging teeth to adaptors, lip shrouds to bucket lips, or other analogous uses. The wear member includes at least one pin-retainer-receiving opening in one side. The opening is tapered, being narrower at its outer surface and wider at its inner surface. The support structure includes at least one pin-receiving recess which generally aligns with the opening in the wear member when the wear member and the support structure are operatively coupled. The pin retainer is a frustoconically shaped cylinder which is threaded internally. It is inserted into the opening in the wear member. The wear member is slidably mounted onto the support structure. The pin is an elongate body which is externally threaded. It is screwed into the pin retainer by the application of torque force from a standard ratchet tool. The pin extends through the wear member and into the recess in the support structure to lock the wear member to the support structure. The pin may be released using a ratchet tool and removed from the pin retainer. The wear member may then be removed from the support structure.

9 Claims, 9 Drawing Sheets

FIGURE 1 WEAR MEMBER WITH PIN-RETAINER RECEIVING HOLE

FIGURE 2 PIN RETAINER WITH INTERNAL THREADS

FIGURE 3 PIN RETAINER READY FOR INSTALLATION IN WEAR MEMBER

PIN-RECEIVING RECESS IN SUPPORT STRUCTURE FOR WEAR MEMBER

FIGURE 5 TURNABLE THREADED LOCK PIN WITH EXTERNAL THREADS AND RECESS FOR HEXAGONAL TURNING TOOL
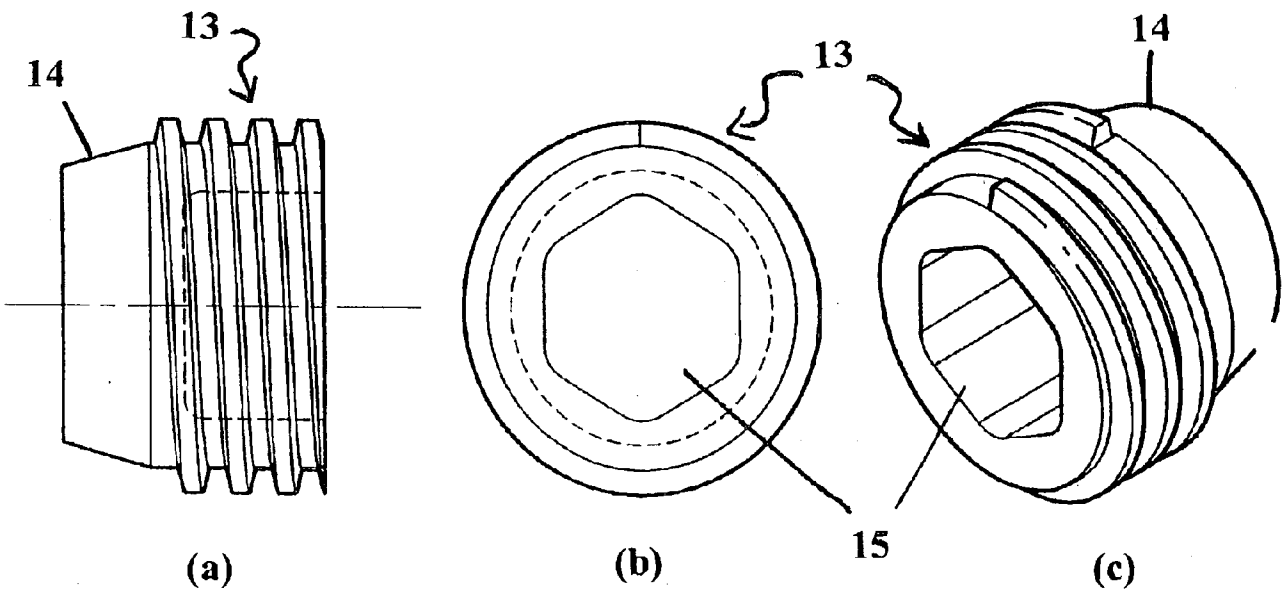

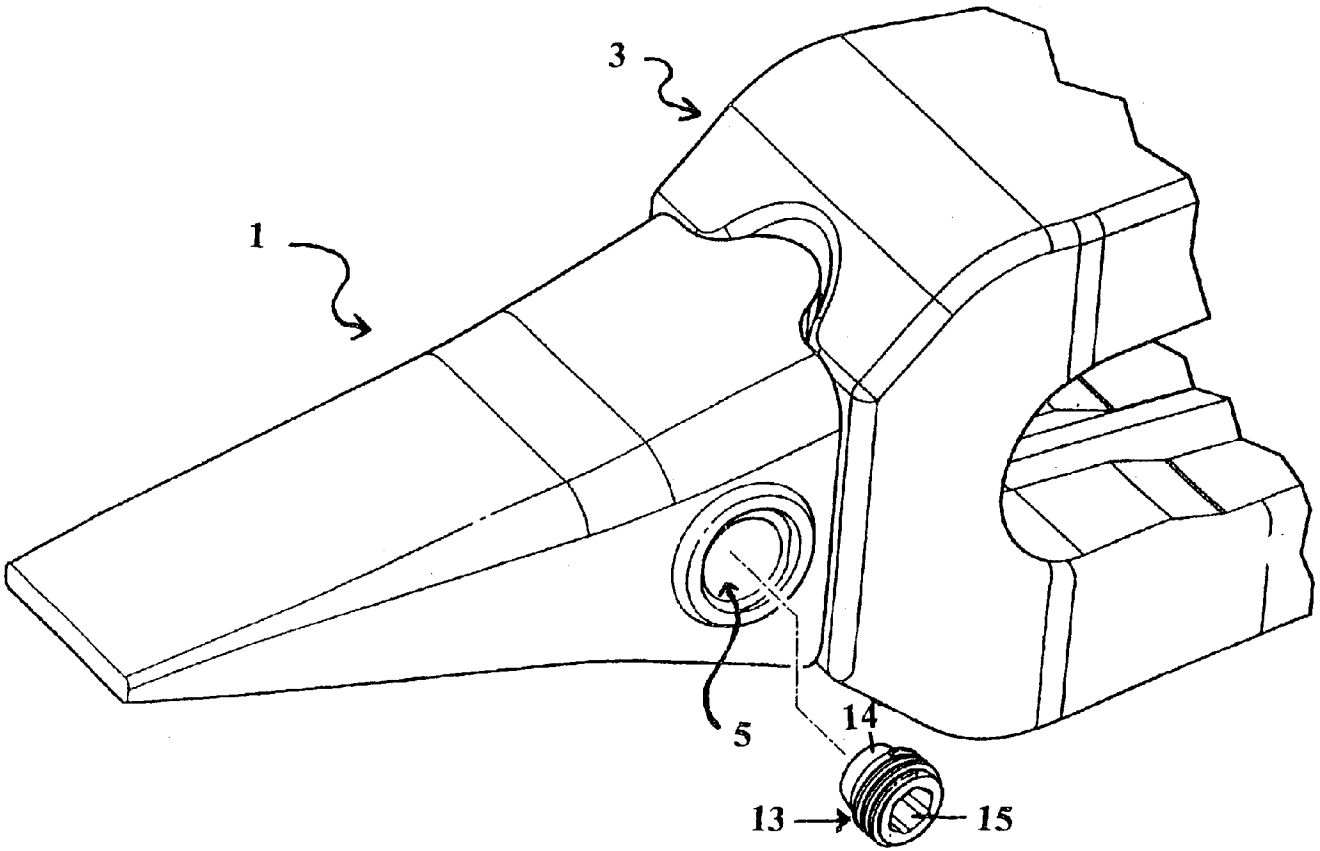
FIGURE 6 LOCK PIN READY FOR INSTALLATION IN WEAR MEMBER MOUNTED ON SUPPORT STRUCTURE

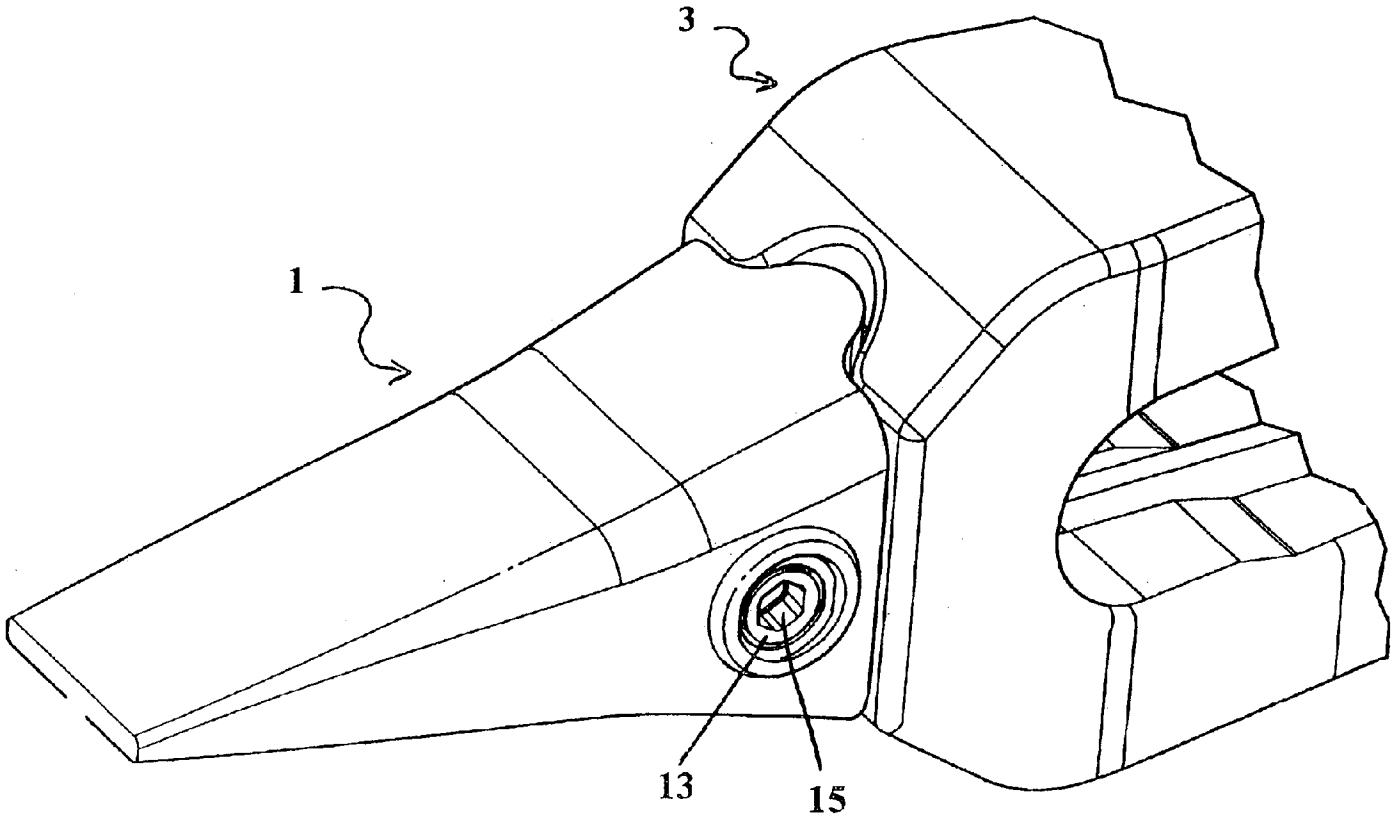
FIGURE 7 WEAR MEMBER MOUNTED AND LOCKED TO SUPPORT STRUCTURE, READY FOR USE

TORQUE LOCKING SYSTEM FOR FASTENING A WEAR MEMBER TO A SUPPORT STRUCTURE

CROSS REFERENCE TO RELATED APPLICATIONS

This application claims priority to Canadian Patent Application No. 2,312,550, filed Jun. 27, 2000 which is incorporated herein by reference.

FIELD OF THE INVENTION

The present invention relates to the field of assemblies for fastening wear members to support structures, for example, ground engaging teeth to adaptors of powered equipment.

BACKGROUND OF THE INVENTION

Many types of excavating equipment utilize replaceable ground-engaging teeth. These teeth erode through use and are frequently replaced. Depending on the conditions, a given support structure or adaptor would be re-equipped with from 5 to 30 teeth to maintain a sharp penetrating edge during excavation. The ease of replacement of the teeth is important because it minimizes the amount of wasted throw-away material and also minimizes the downtime of the tool.

The prior art assemblies used to attach a tooth to the adaptor consist mainly of two designs, the wedge design and the pin design. In the wedge design, the tooth is joined to the adaptor by wedges which are hammered into corresponding slots in the tooth and the adaptor. This design has the disadvantage that the wedges would often become dislodged during use of the excavating equipment. To prevent this problem, the wedge was tack-welded in place. However, removal of the wedges became difficult and time consuming. It also required the drag-line bucket, for example, to be turned on its front end to gain access to the wedges. Further, during removal, the wedges had a tendency to shatter or break causing pieces to jam in the slots and posed a serious safety hazard to workers. Wedge designs are shown, for example, in U.S. Pat. No. 3,256,622.

Pin assemblies are shown in U.S. Pat. No. 2,121,993. This patent discloses a threaded pin and insert assembly for securing a tooth onto the adaptor. The threaded insert is placed into the adaptor pin opening. The tooth is placed over the adaptor. A lock washer is concentrically placed over the pin opening on the tooth. The pin is then screwed into the insert. This assembly had the disadvantage of being cumbersome and complex in design making it difficult to use and increasing the time needed to replace the tooth. As well, the pin has a tendency to loosen from the insert while the tooth is in use. Another pin assembly is shown in U.S. Pat. No. 3,410,010 which discloses a dipper tooth having a detent and key assembly inserted into a passage in the tooth and adaptor. This assembly suffers from the drawback that the key would often fall out of the passage during use of the tooth allowing the tooth to fall off the adaptor.

These wedge and pin assemblies were used not only for attaching ground-engaging teeth to adaptors on excavating equipment but also for attaching other types of wear members to support structures such as for example, attaching a protective lip shroud to a bucket lip.

There is therefore a need for an assembly to attach a removable wear member to a support structure in such a way that the assembly is easy to use, reliable, and economical to manufacture. The assembly needs to be easily installed and removed without the use of force or impact on the locking device. It needs to be easily installed and simple to remove so that wear member changes can be accomplished with minimum effort and maximum safety. It needs to remain functional throughout its service life so that even after a long period of use, it can still easily release a worn-out wear member that is due for replacement.

SUMMARY OF THE INVENTION

It is therefore an object of the present invention to overcome the disadvantages of the prior art. It is a further object to provide a locking assembly for attaching a wear member to a support structure that is easy to install and remove, does not require the application of any significant force or impact to install or remove, and that remains functional during long periods of use.

There is therefore provided an assembly for operatively attaching a wear member to a support structure, wherein the wear member and support structure respectively have a first and second passage which are co-extensive and form a common passage when the wear member is operatively coupled to the support structure, the assembly comprising: a pin retainer receivable in non-rotatable position within the first passage; and pin means insertable within the pin retainer and extending through the first passage and into the second passage to operatively lock the wear member to the support structure.

There is also provided an assembly for operatively attaching a wear member to a support structure, wherein the wear member and support structure respectively have a first and second passage which are co-extensive and form a common passage when the wear member is operatively coupled to the support structure, the assembly comprising: a pin retainer receivable in the first passage in the wear member, said pin retainer having an outer surface, an inner end and outer end; retaining means for retaining the pin retainer in the first passage; and pin means insertable within the pin retainer and extending through the first passage and into the second passage to operatively lock the wear member to the support structure.

There is also provided in a further embodiment of the present invention a method for locking a wear member to a support structure wherein the wear member has a first passage and the support structure has a second passage which are coextensive when the wear member is operatively coupled to the support structure, comprising the steps of: inserting a pin retainer into the first passage in the wear member whereby the pin retainer is held in non-rotatable position; coupling the wear member to the support structure so that the first and second passages are co-extensive; and inserting a pin means into the pin retainer by the application of torque force wherein the pin means extends through the first passage and into the second passage to lock the wear member to the support structure.

BRIEF DESCRIPTION OF THE DRAWINGS

Preferred embodiments of the present invention will now be described and may be better understood when read in conjunction with the following drawings in which:

FIG. 5*a–c* is a side (a), top (b), and bottom perspective (c) view of a turnable, externally threaded lock pin.

FIG. 6 is a perspective view of a wear member mounted on a support structure with a lock pin positioned for installation.

FIG. 7 is a perspective view of a wear member locked on a support structure with a lock pin.

DETAILED DESCRIPTION OF THE INVENTION

With reference to the Figures, there is provided an assembly and method for locking a wear member to a support structure. The locking mechanism may be used to lock a tooth to an adaptor, a lip shroud to a bucket lip, or for other analogous uses.

The assembly comprises a pin retainer and lock pin. The retainer and pin are positioned in a wear member on a support structure having corresponding openings to lock the wear member to the support structure.

Figure 1:
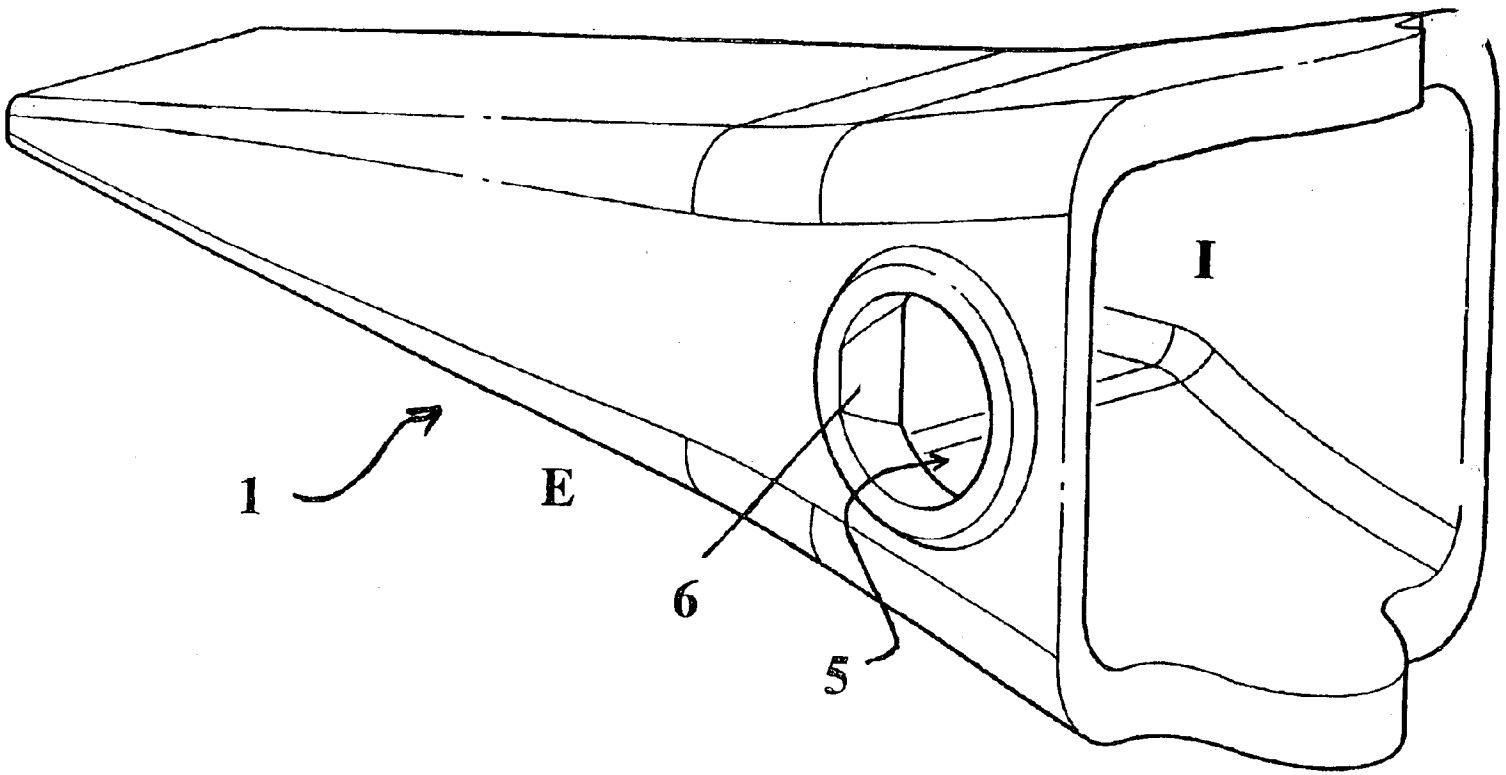
FIG. 1 is a perspective view of a wear member having a pin receiving opening in the side wall thereof in accordance with one embodiment of the present invention.
Figure 4:
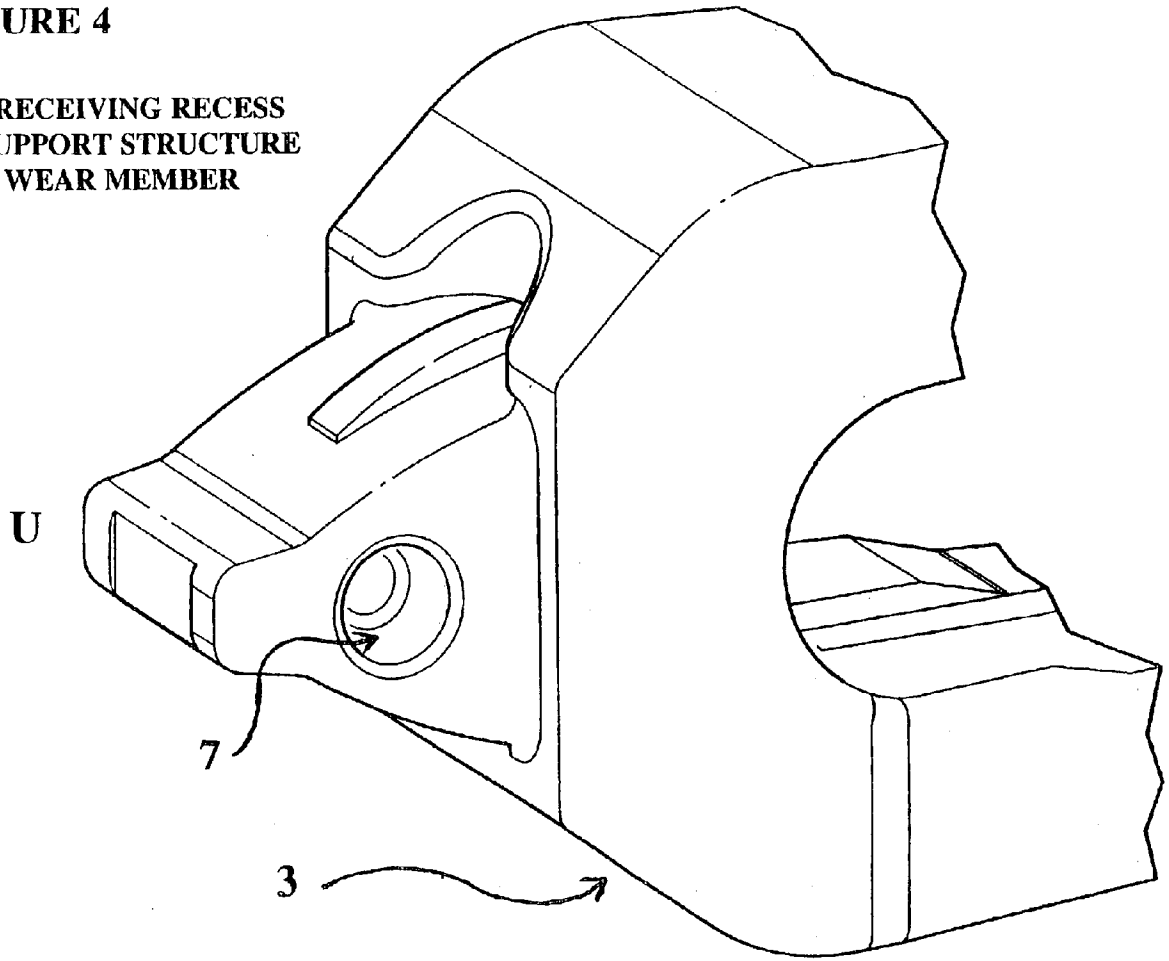
FIG. 4 is a partial perspective view of a wear member support structure having a pin receiving recess.

An excavating tooth or wear member generally has a triangular shaped cross-section and is formed so as to be received over the working end of a support structure. A wear member 1 is shown in FIG. 1 and a support structure 3 in FIG. 4. The wear member has an external surface E and an internal surface I. The wear member has at least one pin-retainer-receiving opening 5 extending through its wall from its external surface E to its internal surface I. This opening 5 is positioned in one side of the wear member 1. The walls of this opening 5 are frustoconical in cross-section, being narrower at the external (wearable) surface E of the wear member 1 and wider at the internal surface I of the wear member 1. The frustoconical walls of the opening 5 are interrupted by at least one anti-rotation surface 6 that prevents the pin retainer, described below, from rotating within the opening 5. The support structure 3 has an upper, working end U. For the general ground-engaging tooth/adaptor class of wear member and support structure, the wear member is normally installed on the support structure by sliding the anterior cavity of the wear member on the protruding nose of the upper end U of the support structure. The two parts then fit snugly together. The support structure 3 has an pin-receiving recess 7 which generally aligns with the pin-retainer-receiving opening 5 in the wear member 1 when the wear member is in operational position on the support structure 3. Preferably, the central axis of the pin retainer, when installed in the opening 5 of the wear member, lines up a small distance forward (toward the working end of the wear member) from the matching axis of the lock pin receiving recess 7 in the support structure 3. This intentional misalignment of the frustoconical pin and frustoconical recess creates a wedge effect that forces the wear member tightly onto the support structure when the lock pin is fully inserted and tightened down in the pin retainer.

Figure 2:
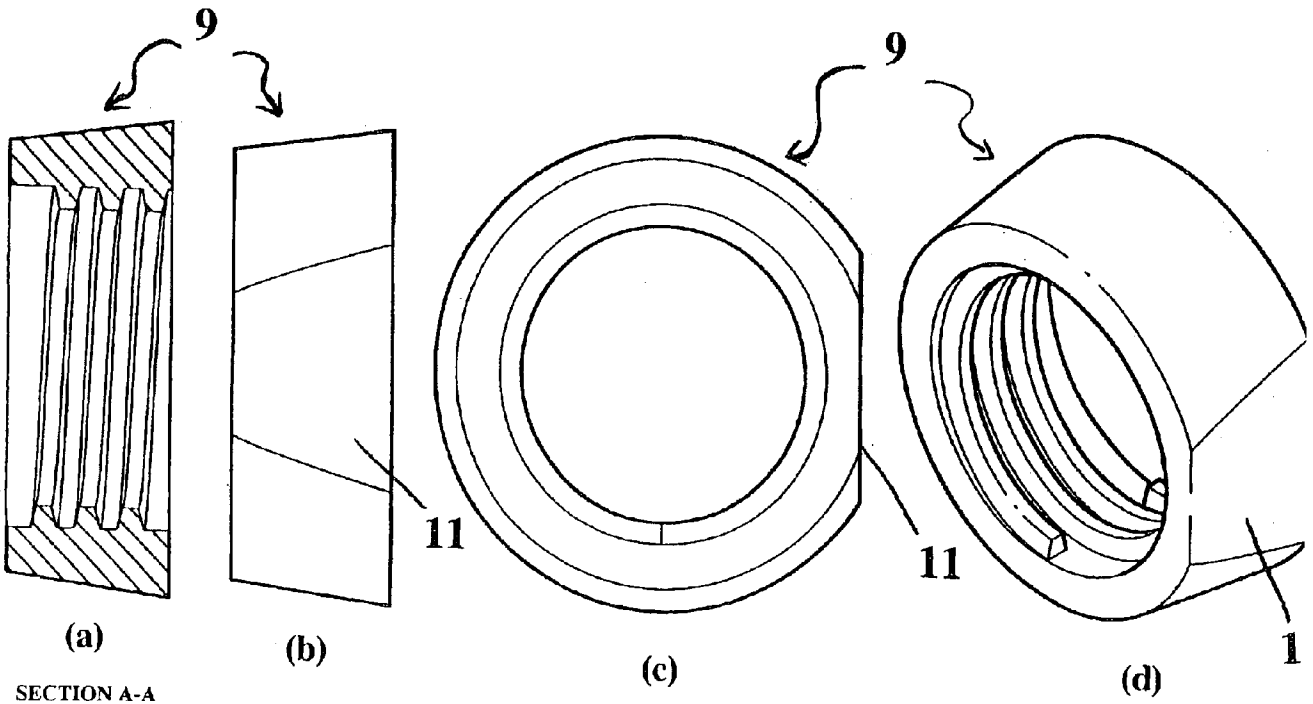
FIG. 2*a–d* are side cross-sectional (a), side (b), top (c) and perspective (d) views of a pin retainer with internal threads for mounting in the wear member shown in FIG. 1.

The pin retainer 9 of the present invention is inserted into the pin-retainer-receiving opening 5 in the wear member 1. Therefore, its shape corresponds to the shape of the opening 5. It is shown in FIG. 2 as having an external surface which is generally circular. The pin retainer 9 is tapered. The external surface is shown with a flat wall 11. This wall 11 corresponds to a flat wall 6 on the inner surface of the pin-retainer-receiving opening 5 in the wear member 1. When the pin retainer 9 is inserted into the pin-retainer-receiving opening 5 in the wear member 1, the flat wall 11 of the pin retainer aligns with the corresponding flat wall 6 in the opening 5. The pin retainer is now held in a non-rotatable position within the opening and will not turn inside the opening when torque is applied to install a pin in the retainer. The pin retainer 9 is threaded internally to receive a lock pin described below.

The pin retainer described and shown in the drawings is one preferred embodiment. Other configurations of the pin retainer are possible and would be obvious to a skilled person in this field. For example, the pin retainer need not be radially symmetric. Any polygonal shape would serve to prevent rotation of the pin retainer within a receiving hole of matching shape. Similarly, it is not necessary that the peripheral surface of the pin retainer have a frustoconical taper. The pin retainer must be received into the pin-retainer-receiving opening in the wear member so that it cannot pass through the opening and fall out. The retainer (and correspondingly the opening) may simply be wider on the inside surface than on the outside surface.

Figure 9:
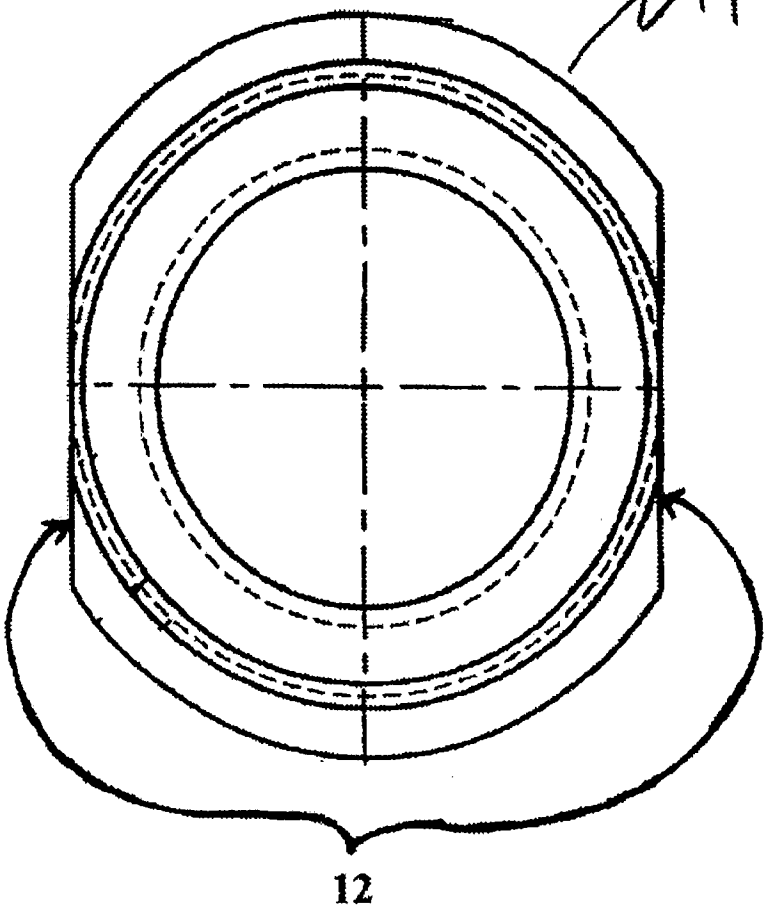
FIG. 9 is a top view of the alternative embodiment for the pin retainer shown in FIG. 8.
Figure 8:
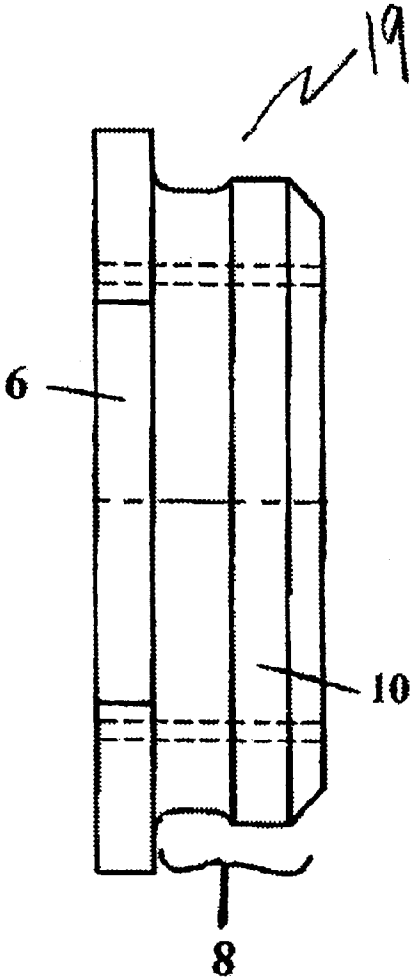
FIG. 8 is a side view of an alternative embodiment for the pin retainer.
Figure 10:
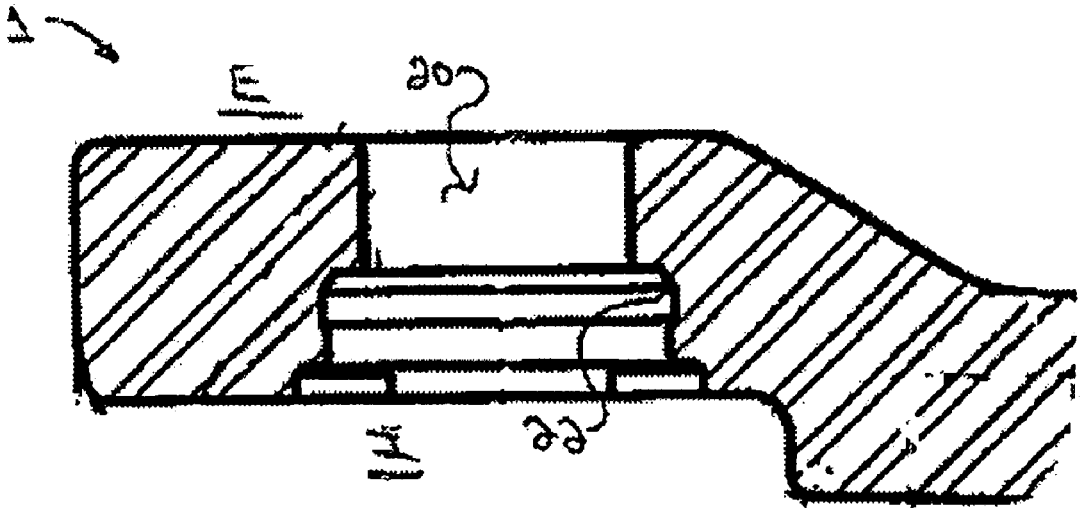
FIG. 10 is a cross section view of another embodiment of the wear member for use with the pin retainer shown in FIG 8 and 9.

An alternative embodiment for the pin retainer, denoted by reference numeral 19, is shown in FIGS. 8 and 9. This pin retainer has a base portion 6 and an extended portion 8. The extended portion has a band 10 with a wider diameter than the remaining sections of the extended portion. The outer section of the extended portion 8 of the pin retainer may be tapered to some degree to facilitate insertion into the opening 5. The band portion 10 of the pin retainer fits into a corresponding groove in the inner surface of the opening 5 to retain the pin retainer in the opening. The shape of the opening would correspond to the shape of the pin retainer so that the pin retainer would be inserted into the opening and its band would 'snap' into the groove thereby holding the pin retainer in the opening. As shown in FIG. 9, the outer circumference of the pin retainer has two flat surface walls 12. These walls will correspond to two flat walls in the opening 5 to retain the pin retainer in a non-rotatable position in the opening.

The pin retainer may be manufactured from any type of suitable material. Preferably, it is manufactured from a resilient polymer, such as for example resilient polycarbonate, however, other materials may be used.

The lock pin 13 of the present invention is comprised of a generally circular elongated body as shown in FIG. 5. The pin 13 is threaded externally. Its threaded portions engage the matching threads on the interior of the pin retainer as shown in FIG. 6. It includes a frustoconical end 14 which protrudes into the anterior cavity of the wear member when the lock pin is threaded into the pin retainer in the installed position as shown in FIG. 7. In this position, the frustoconical end 14 of the pin is received into the pin receiving recess 7 in the support structure 3. The pin is shown as having an opening 15. The opening 15 is shown as having a hexagonal shape. The pin 13 is received into the pin retainer 9 in the wear member 1 and the pin receiving recess 7 in the support structure when the wear member is positioned on the support structure. The lock pin 13 generally corresponds to the internal shape of this pin retainer 9 and recess 7 and therefore, the shape of the pin may vary from that shown in FIG. 5.

Figure 3:
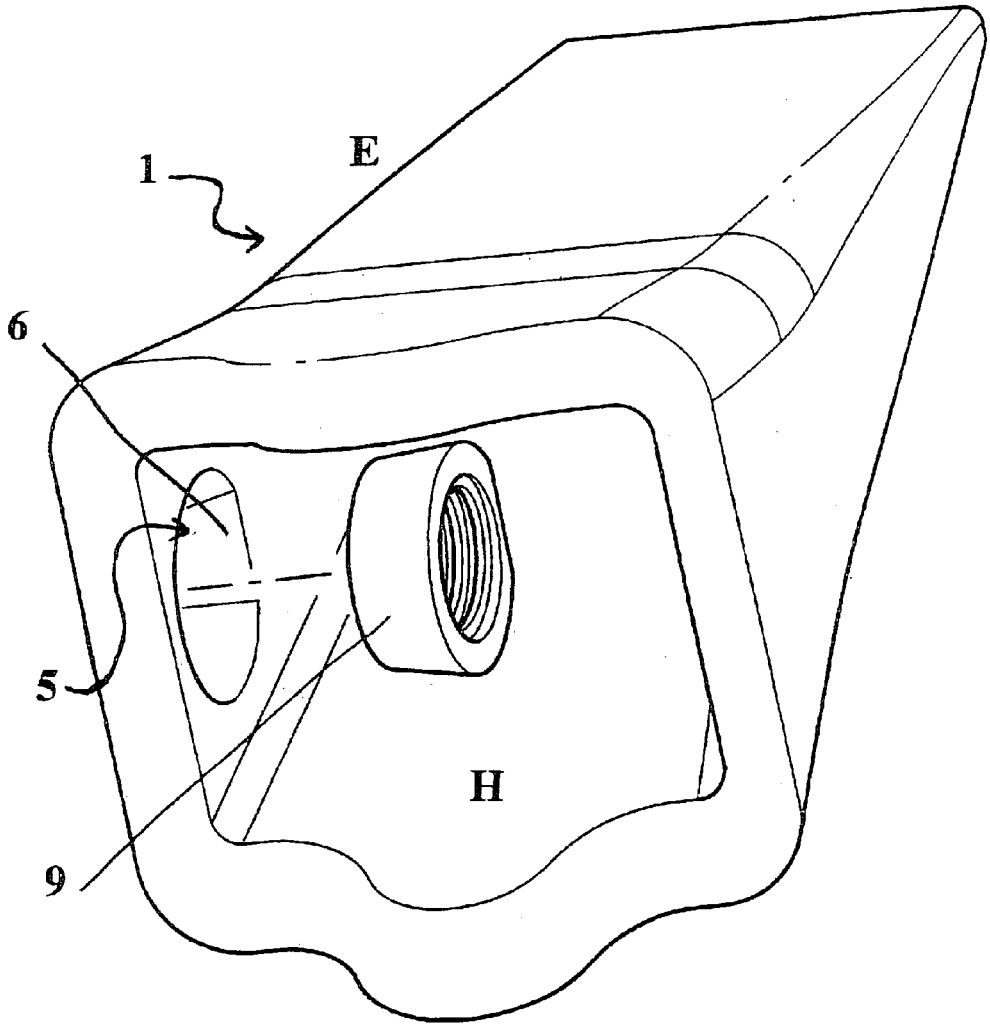
FIG. 3 is a perspective view of a wear member and a pin retainer from FIGS. 1 and 2.

To lock a wear member 1 to a support structure 3, the pin retainer 9 is placed in the pin-retainer-receiving opening 5 in the wear member by inserting the retainer 9 into the opening 5 from the internal surface I of the wear member. This step is shown in FIG. 3. The retainer 9 is received into the tapered opening 5 and is locked in non-rotatable position. The wear member 1 is installed on the support structure by sliding the anterior cavity of the wear member over the protruding nose of the working end U of the support structure 3 as shown in FIG. 6. The opening 5 in the wear member should now generally align with the recess 7 in the support structure. The lock pin 13 is placed in the pin retainer 9 by screwing it into the retainer. The lock pin may be placed into the retainer prior to installation of the wear member on the support structure as long as the inner end of the lock pin is flush with the interior surface of the wear member or does not protrude into the anterior cavity of the wear member to interfere with the installation of the wear member on the support structure. The lock pin 13 is tightened in the retainer by torquing it down using a ratchet in the opening 15 of the lock pin. When fully inserted into the retainer, the lock pin extends through the opening 5 in the wear member 1 and into the recess 7 in the support structure 3. When fully inserted, the head of the lock pin 13 will be flush with the external surface of the wear member. This locked positioned is shown in FIG. 7. A plug may be placed in the centre opening 15 of the lock pin 13 during use of the wear member 1 to prevent dirt and other debris from filling this opening 15. When the locking assembly is fully installed and the wear member is locked to the support structure, the locking assembly is contained within the wear member. It does not extend past the external surface of the wear member and therefore is not affected or deteriorated by the use of the wear member.

To unlock the wear member from the support structure, a ratchet is used to rotate the pin 13 to loosen it from the pin retainer 9. The lock pin 13 is unscrewed from the pin retainer 9 either until its inner edge is flush with the inside surface of the wear member or it may be fully removed. The wear member 1 may then be removed from the working end U of the support structure 3. The pin retainer 9 may be removed from the opening 5 in the wear member 1 by pushing it towards the internal surface I of the wear member. The wear member and/or the locking assembly may be replaced.

The installation and removal of this assembly does not require any significant force or impact. The lock pin is tightened and removed from the pin retainer by the application of torque from a standard ratchet tool. The equipment installer is therefore in no danger of personal injury by flying fragments of a broken hammer, locking pin, or wedge. The assembly contains only one moving part, the pin within the retainer. It does not contain internal cavities which would accumulate dirt and interfere with the operation of the locking assembly. The locking assembly is economic to manufacture and easy to install and therefore may be completely replaced by a new assembly every time the wear member is replaced.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

We claim:

1. An assembly for operatively attaching a wear member to a support structure, wherein the wear member and support structure, respectively, have a first and second passage, which are co-extensive and form a common passage when the wear member is operatively coupled to the support structure, the assembly comprising:

a resilient pin retainer receivable in a non-rotatable position within the first passage, the pin retainer being threaded internally; and pin means having threaded portions corresponding to the threaded portions of the pin retainer, wherein when the pin means engages the pin retainer by the application of torque force, the pin means extends through the first passage and into the second passage for operatively locking the wear member to the support structure, and in combination with the support structure, for bearing substantially all of the wear member-removal forces during use of the wear member.

2. The assembly of claim 1, wherein the central longitudinal axis of the first passage is forward of the central longitudinal axis of the second passage to allow the pin means to tightly lock the wear member to the support structure.

3. An assembly for operatively attaching a wear member to a support structure, wherein the wear member and support structure, respectively, have a first and second passage, which are co-extensive and form a common passage when the wear member is operatively coupled to the support structure, the assembly comprising:

a pin retainer receivable in the first passage, said pin retainer being threaded internally and being substantially non-load bearing in respect of wear member-removal forces during use of the wear member; and pin insertable within the pin retainer and having threaded portions corresponding to the threading of the pin retainer wherein when the pin is inserted into the pin retainer, the pin extends through the first passage and into the second passage to operatively lock the wear member to the support structure.

4. The assembly of claim 3 wherein a central longitudinal axis of the first passage is slightly offset from a central longitudinal axis of the second passage.

5. The assembly of claim 3 wherein the pin retainer and first passage have corresponding surfaces which retain the pin retainer in a non-rotatable position.

6. The assembly of claim 3 wherein the pin retainer is held in position in the first passage by the support structure when the wear member is operatively positioned on the support structure.

7. The assembly of claim 3 wherein the pin contacts a surface of the first passage during use of the wear member as a result of wear-member removal forces.

8. An assembly for operatively attaching a wear member to a support structure, wherein the wear member and support structure, respectively, have a first and second passage, which are co-extensive and form a common passage when the wear member is operatively coupled to the support structure, the assembly comprising:

a resilient pin retainer receivable in the first passage, the pin retainer being substantially non-load bearing in respect of wear member-removal forces during use of wear member; and a pin insertable within the pin retainer and, when inserted, extending through the first passage and into the second passage for operatively locking the wear member to the support structure wherein the pin retainer has a tapered outer surface having the outer end of the pin retainer narrower than the inner end of the pin retainer, wherein when the pin retainer is inserted into the first passage and the wear member is operatively positioned on the support structure, the pin retainer is held in position.

9. An assembly for operatively attaching a wear member to a support structure, wherein the wear member and support structure, respectively, have a first and second passage, which are co-extensive and form a common passage when the wear member is operatively coupled to the support structure, the assembly comprising:

a resilient pin retainer receivable in the first passage, the pin retainer being substantially non-load bearing in respect of wear member-removal forces during use of wear member; and a pin insertable within the pin retainer and, when inserted, extending through the first passage and into the second passage for operatively locking the wear member to the support structure wherein the retaining means comprise at least one substantially flat surface on the pin retainer and at least one corresponding substantially flat surface in the first passage.

* * * * *